US010881136B1

(12) United States Patent
Li et al.

(10) Patent No.: US 10,881,136 B1
(45) Date of Patent: Jan. 5, 2021

(54) ATOMIZING DEVICE SUPPORTING MULTIPLE INHALATION MODES AND METHOD OF USING THE SAME

(71) Applicant: CHINA TOBACCO YUNNAN INDUSTRIAL CO., LTD, Kunming (CN)

(72) Inventors: Tinghua Li, Kunming (CN); Donglai Zhu, Kunming (CN); Yi Han, Kunming (CN); Shoubo Li, Kunming (CN); Yongkuan Chen, Kunming (CN); Wei Zhao, Kunming (CN); Xia Zhang, Kunming (CN); Xiaowei Gong, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 16/623,769

(22) PCT Filed: Jun. 21, 2019

(86) PCT No.: PCT/CN2019/092284

§ 371 (c)(1),
(2) Date: Dec. 18, 2019

(87) PCT Pub. No.: WO2020/147262

PCT Pub. Date: Jul. 23, 2020

(30) Foreign Application Priority Data

Jan. 17, 2019 (CN) ..... 2019 1 0043710

(51) Int. Cl.
*A24F 40/30* (2020.01)
*A24F 40/46* (2020.01)
(Continued)

(52) U.S. Cl.
CPC ..... *A24F 40/30* (2020.01); *A24F 40/20* (2020.01); *A24F 40/46* (2020.01); *A24F 40/57* (2020.01); *A24F 40/60* (2020.01)

(58) Field of Classification Search
CPC ..... A24F 40/20
See application file for complete search history.

(56) References Cited

U.S. PATENT DOCUMENTS

2013/0014772 A1* 1/2013 Liu ..... A24F 47/008 131/329
2015/0237914 A1* 8/2015 Han ..... A24F 47/008 131/329

(Continued)

FOREIGN PATENT DOCUMENTS

CN 204409589 U 6/2015
CN 204519367 U 8/2015

(Continued)

*Primary Examiner* — Anthony Calandra
(74) *Attorney, Agent, or Firm* — Bayramoglu Law Offices PLLC

(57) ABSTRACT

An atomizing device supporting multiple inhalation modes includes the following components: the main body housing, the main support, the upper end cover, the atomizer placed on the atomizer base, and the lower end cover. A method of using the atomizing device is further provided. The atomizing device of the present invention supports three inhalation modes, and the inhalation mode and the airflow channel can be switched synchronously; the temperature control for aroma generation during low-temperature baking is accurate, the utilization of cigarettes is sufficient and the inhalation comfort is satisfying. Likewise in the "cigarette tar atomizing+cigarette baking" mode, smoke from the atomized cigarette tar and the smoke from the cigarette baking are fully mixed to yield a rich aroma that is comfortable to inhale, and provides a satisfactory smoking experience.

17 Claims, 4 Drawing Sheets

(51) Int. Cl.

| | |
|---|---|
| ***A24F 40/60*** | (2020.01) |
| ***A24F 40/57*** | (2020.01) |
| ***A24F 40/20*** | (2020.01) |

(56) References Cited

U.S. PATENT DOCUMENTS

| | | | | |
|---|---|---|---|---|
| 2016/0198771 | A1 | 7/2016 | Goggin et al. | |
| 2018/0042299 | A1* | 2/2018 | Han | A24F 47/008 |
| 2019/0200673 | A1* | 7/2019 | Bless | A24F 47/008 |
| 2019/0217028 | A1* | 7/2019 | Nakano | A24F 47/00 |
| 2020/0146359 | A1* | 5/2020 | Stephens | H01M 10/425 |
| 2020/0154766 | A1* | 5/2020 | Jeong | A24F 47/00 |

FOREIGN PATENT DOCUMENTS

| | | | |
|---|---|---|---|
| CN | 106983178 | A | 7/2017 |
| CN | 206744571 | U | 12/2017 |
| CN | 109602091 | A | 4/2019 |

* cited by examiner

ATOMIZING DEVICE SUPPORTING MULTIPLE INHALATION MODES AND METHOD OF USING THE SAME

CROSS REFERENCE TO THE RELATED APPLICATIONS

This application is the national phase entry of International Application No. PCT/CN2019/092284, filed on Jun. 21, 2019, which is based upon and claims priority to Chinese Patent Application No. 201910043710.5, filed on Jan. 17, 2019 the entire contents of which are incorporated herein by reference.

TECHNICAL FIELD

The present invention belongs to the technical field of electronic cigarettes, and specifically relates to an atomizing device supporting multiple inhalation modes and a method of using the same.

BACKGROUND

In recent years, under the combined pressures of global smoking restrictions and changing public opinion, the development of traditional cigarettes has been increasingly restricted. The research on tar reduction and harm reduction techniques, and the development of new, less harmful tobacco products, have become an inevitable choice for the tobacco industry to adapt a new normal. This in turn allows the tobacco industry to grasp new opportunities to support the sustainable and healthy development of tobacco products.

Traditional tar and harm reduction techniques includes mainly: accelerating the burning speed of cigarettes; changing the burning characteristics of cigarettes by adding tobacco sheets, cut stems and others to tobacco shreds. Or using cigarette papers with high-air permeability; selectively trapping harmful components in the smoke by adding adsorbents such as activated carbon to the filter tip. Alternatively by using a multi-component filter tip; ventilating and diluting the smoke by perforating the tipping paper or using perforated paper. It is worth mentioning that, although the aforementioned techniques can reduce the tar and the harm to a certain extent, the cigarettes still need to be burned and the smoke will still need to be inhaled. That said, the harmful substances generated by the burning process should not be underestimated. The scientific community has confirmed that low-temperature baking of cigarettes or heated atomizing of cigarette tar is a healthier choice to traditional combustion smoking. However, current low-temperature baking techniques generally have problems such as inaccurate temperature control for aroma production, inefficient use of cigarettes, along with other problems. Meanwhile, atomizing pure cigarette tar has the shortcomings of poor inhalation quality and weak aroma, a heavy sweet greasy feeling and other problems. Therefore, the technical problems in the prior art, regarding these types of electric cigarettes, needs to be improved.

SUMMARY

In view of the above deficiencies of the prior art, the present invention provides an atomizing device supporting multiple inhalation modes and a method of using same. The atomizing device supports three inhalation modes, i.e., cigarette tar atomizing, cigarette baking, and "cigarette tar atomizing+cigarette baking". These diversified functions can fully meet the user's multifaceted inhalation demand. Different inhalation modes and corresponding airflow channels can be switched synchronously, and the degree of intellectualization is high. Temperature control for aroma generation during low-temperature baking is accurate so as to maximize aroma generation, and increase the efficiency of the utilization rate of cigarettes. When operating in the "cigarette tar atomizing+cigarette baking" mode, the smoke from the atomized cigarette tar and the smoke from the cigarette baking can be fully mixed, yielding a rich aroma that is comfortable to inhale, and a satisfactory smoking experience.

The technical solution of the present invention to solve the technical problems in the prior art is as follows:

According to a first aspect of the present invention, an atomizing device supporting multiple inhalation modes is provided, including the following components.

the main body housing 7, wherein the main body housing 7 is substantially cylinder-shaped with an upper end opening and a lower end opening;

the main support 2, wherein the main support 2 is located in the main body housing 7; the top and bottom of the main support 2 are provided with the upper cover board 21 and the lower cover board 22, respectively; the upper cover board 21 and the lower cover board 22 are fixedly connected by segregation boards, and the space between the upper cover board 21 and the lower cover board 22 is divided into several cavities by the segregation boards; the control circuit board 3, the cigarette baking component 6 and a battery are placed in different cavities;

the upper cover board 21, wherein the upper end surface of the upper cover board 21 is provided with the magnet 213 and the atomizer base 211, and the cigarette insertion hole 212 is further formed on the upper cover board 21;

the lower cover board 22, wherein the lower end surface of the lower cover board 22 is provided with three position sensing contacts, namely the first position sensing contact 2211, the second position sensing contact 2212 and the third position sensing contact 2213; the first air inlet 2221 and the second air inlet 2222 are further formed on the lower cover board 22 by penetrating the end surface;

the upper end cover 1, wherein the top of the upper end cover 1 is provided with the inhalation nozzle 11 and the lower end surface of the upper end cover 1 is adapted to the upper end opening of the main body housing 7; the lower end surface of a cone is provided with two holes separate to each other leading into a cavity of the cone as the first air outlet channel 12 and the second air outlet channel 13, and the lower end surface of the upper end cover 1 is further provided with the magnetic column 14;

the atomizer 5, wherein the atomizer 5 is placed on the atomizer base 211; the atomizer 5 is fixed to the atomizer base 211 by a magnetic manner, a screwing manner or a snap manner, and realizes an electrical connection;

the lower end cover 4, wherein the upper end surface of the lower end cover 4 is adapted to the lower end opening of the main body housing 7, and the lower end surface of the lower end cover 4 is provided with the mode switching disc 41; the mode switching disc 41 is connected to the rotating pad 42 located on the upper end surface of the lower end cover 4 through the self-locking rotating shaft 43; the rotating position contact 421 and the air inlet sealing plug 422 opposite to each other are placed on the rotating pad 42 along the self-locking rotating shaft 43, and a connection line between the rotating position contact 421 and the air inlet sealing plug 422 passes through the self-locking rotating shaft 43; the lower end surface of the mode switching disc 41 is provided with three identifications, namely the first mode identification 411, the second mode identification 412, and the third mode identification 413; the edge of the upper end surface of the lower end cover 4 is provided with the fastening assembly 44.

The connection manner of each component is as follows.

The upper end cover 1 and the main support 2 are tightly engaged by the magnetic effect between the magnetic column 14 and magnet 213. The lower end cover 4 and the main support 2 are connected in the snap manner by the fastening assembly 44, and at this time, the upper end surface of the lower end cover 4 is affixed to the lower end surface of the lower cover board 22. The upper port of the cigarette baking component 6 corresponds to the cigarette insertion hole 212. The magnetic column 14 is substantially column-shaped, and a material thereof is one of iron, cobalt, nickel or other magnetic materials. A material of the magnet 213 is one of neodymium iron boron magnet, ferrite magnet, samarium cobalt magnet, aluminum nickel cobalt magnet or iron chrome cobalt magnet. Generally, the control circuit board 3 is disposed directly under the atomizer base 211, and the battery is placed directly under the magnet 213.

Preferably, the cigarette baking component 6 is substantially cylinder-shaped. The outer wall of the cylinder body is wrapped with the thermal insulation assembly 65. The filter tip accommodating cavity 63, the first heating cavity 61 and the second heating cavity 62 are, from top to bottom, disposed in the inner cavity of the cylinder body. The first heating cavity 61 and the second heating cavity 62 adopt an integrated structure design and a zone heating and using method, and the heating cavity may be a metal cup, a ceramic cup printed with a heating circuit or a glass cup. The cavity wall of the first heating cavity 61 and the second heating cavity 62 is provided with the temperature sensor 64. The first heating cavity 61 and the second heating cavity 62 are used for accommodating a cigarette, wherein the cigarette includes a general burning and inhaling cigarette, a heating and non-burning cigarette, and a dual-purpose cigarette in a general burning and inhaling manner and a heating non-burning manner. The temperature sensing module 38 feeds back temperatures of the first heating cavity 61 and the second heating cavity 62 to the microcontroller 31. The thermal insulation assembly 65 is made of a porous material, a heat reflective material or a vacuum material. The ratio of upper section and lower section of the cigarette may be 8:2, 7:3, 6:4, 5:5, 4:6, 3:7 and 8:2, preferably 5:5.

Preferably, the atomizing device also includes the gathering assembly 8. The gathering assembly 8 is detachably disposed at the lower port of the cigarette baking component 6. The gathering assembly 8 is used for collecting condensate, such as tar, generated during the cigarette baking process.

Preferably, the control circuit board 3 includes the microcontroller 31, the power management module 32, the cigarette tar atomizing control module 33, the cigarette baking control module 34, the information display module 35, the key detection module 36, the mode analysis module 37 and the temperature sensing module 38.

Preferably, the main body housing 7 has a substantially Y-shaped cross section, and the outer wall of the main body housing 7 is provided with the main key 71, the display screen 72 and the charging interface 73. The charging interface 73 can both charge the atomizing device and realize firmware upgrade of the atomizing device. The display screen 72 intuitively presents information such as a inhalation mode, a inhalation state, a battery level and the like, to the user.

Preferably, the inhalation nozzle 11 has a retractable structure. When the inhalation nozzle 11 retracts into a cavity of the upper end cover 1, the inhalation nozzle 11 is in a non-communication state with the first air outlet channel 12 and the second air outlet channel 13. When the inhalation nozzle 11 extends out to be used, the inhalation nozzle 11 is in a communication state with the first air outlet channel 12 and the second air outlet channel 13. The first air outlet channel 12 or the second air outlet channel 13 is a Z-shaped arrangement in the cavity of the cone, and the first air outlet channel 12 and the second air outlet channel 13, are used for outputting cigarette tar, atomizing smoke and cigarette baking smoke, respectively. Preferably, the first air inlet 2221 serves as an air inlet through-hole for cigarette tar atomizing; the second air inlet 2222 serves as an air inlet through-hole for cigarette baking.

Preferably, the first air inlet 2221 is arranged opposite to the third position sensing contact 2213. The second air inlet 2222 is arranged opposite to the first position sensing contact 2211. The air inlet sealing plug 422 is adapted to the first air inlet 2221 or the second air inlet 2222, that is, the air inlet sealing plug 422 can close or open the first air inlet 2221 or the second air inlet 2222.

Preferably, the first mode identification 411, the second mode identification 412 and the third mode identification 413 correspond to a cigarette tar atomizing mode, a "cigarette tar atomizing+cigarette baking" mixed mode and a cigarette baking mode, respectively. The mode switching disc 41 drives the rotating pad 42 to rotate by the self-locking rotating shaft 43. The self-locking rotating shaft 43 supports a self-locking positioning of the rotating position contact 421 and three position sensing contacts. When the rotating position contact 421 is in an alignment connection with the first position sensing contact 2211, the air inlet sealing plug 422 closes the second air inlet 2222, and at this time, the cigarette tar atomizing mode is presented and the first air inlet 2221 serves as the air inlet through-hole for cigarette tar atomizing. When the rotating position contact 421 is in the alignment connection with the third position sensing contact 2213, the air inlet sealing plug 422 closes the first air inlet 2221, and at this time, the cigarette baking mode is presented and the second air inlet 2222 serves as the air inlet through-hole for cigarette baking. When the rotating position contact 421 is in the alignment connection with the second position sensing contact 2212, both the first air inlet 2221 and the second air inlet 2222 are opened, and at this time, the "cigarette tar atomizing+cigarette baking" mixed mode is presented.

According to a second aspect of the present invention, a method of using any one of the atomizing devices described above is provided, and the method includes the following steps:

The mode switching disc 41 is rotated to select the inhalation mode of the atomizing device, and the self-locking rotating shaft 43 is used to perform the self-locking positioning, leading that the first mode identification 411, the second mode identification 412 or the third mode identification 413 corresponds to the mode alignment identification 45. Meanwhile, the rotating position contact 421 is automatically in the alignment connection with the first position sensing contact 2211, the second position sensing contact 2212 or the third position sensing contact 2213, wherein the first position sensing contact 2211, the second position sensing contact 2212 or the third position sensing contact 2213 matches the inhalation mode, and the air inlet sealing plug 422 synchronously opens the first air inlet 2221 and/or the second air inlet 2222.

The microcontroller 31, the power management module 32, the information display module 35, the key detection module 36, and the mode analysis module 37 all operate. Meanwhile, the mode analysis module 37 detects a situation about the alignment connection between the first position sensing contact 2211, the second position sensing contact 2212 or the third position sensing contact 2213 and the rotating position contact 421 in real time, analyzes position information, and feeds back to the microcontroller 31. Then, the microcontroller 31 determines the inhalation mode and activates each control circuit board module corresponding to the inhalation mode to work and generate smoke for a user to inhale. That is, in the cigarette tar atomizing mode, the cigarette tar atomizing control module 33 operates in cooperation, and smoke is generated by cigarette tar atomizing; in the cigarette baking mode, the cigarette baking control module 34 and the temperature sensing module 38 operate in cooperation, and smoke is generated by cigarette baking; in the "cigarette tar atomizing+cigarette baking" mixed mode, the cigarette tar atomizing control module 33, the cigarette baking control module 34 and the temperature sensing module 38 operate in cooperation to generate mixed smoke of cigarette tar atomizing smoke and cigarette baking smoke.

Preferably, a method of using the cigarette baking component 6 includes the following steps:

1) in a 0-$t_1$ time period, the first heating cavity 61 and the second heating cavity 62 are heated synchronously, the first heating cavity 61 is continuously heated to $T_3$, and the second heating cavity 62 maintains a constant temperature after being heated to $T_1$;

2) in a $t_1$-$t_2$ time period, the first heating cavity 61 and the second heating cavity 62 maintain constant temperatures $T_3$ and $T_1$, respectively;

3) in a $t_2$-$t_3$ time period, the first heating cavity 61 maintains a constant temperature after being cooled to $T_2$, and the second heating cavity 62 maintains a constant temperature after being heated to $T_3$;

4) in a $t_3$-$t_4$ time period, the first heating cavity 61 continues to maintain the constant temperature $T_2$, and the second heating cavity 62 maintains a constant temperature after being cooled to $T_2$;

5) in a $t_4$-$t_5$ time period, the first heating cavity 61 stops being heated, the second heating cavity 62 continues to maintain the constant temperature $T_2$, and when time is greater than $t_5$, the second heating cavity 62 stops being heated;

wherein, the order of the temperatures is $T_1<T_2<T_3$.

Compared with the prior art, the advantages of the present invention are as follows:

The atomizing device of the present invention adopts a mode switching disc with moderate rotating damping to realize free switching between the different inhalation modes, three gears are adjustable, and the operation is simple and convenient. The three inhalation modes, i.e., cigarette tar atomizing mode, cigarette baking mode, and "cigarette tar atomizing+cigarette baking" mode are supported and can fully meet the user's multifaceted inhaling demand and bring different inhalation experiences to the user.

The atomizing device of the present invention utilizes a self-locking rotating shaft to drive a rotating pad to simultaneously complete the alignment connection of the position sensing contact 2211, 2212 or 2213 to the rotating position contact 421 and control the opening and closing of the air inlet. Meanwhile, the mode analysis module detects the connection situation, analyzes the position information and feeds back to the microcontroller. Then, the microcontroller determines the inhalation mode and activates the corresponding control circuit board module to realize the synchronous and accurate switching between different inhalation modes and the corresponding airflow channels. The degree of intellectualization of the atomizing device is high, and the linkage is stable and reliable.

When the atomizing device of the present invention operates in the cigarette baking mode, the smoke is generated by the low-temperature baking of cigarettes in the heating cavity. Compared with burning and inhaling cigarettes, the harmful substances generated by the pyrolysis are greatly reduced and the health risk is small. When the atomizing device operates in the "cigarette tar atomizing+cigarette baking" mode, the cigarette tar atomizing smoke (i.e. the smoke from atomized cigarette tar) and the cigarette baking smoke are fully mixed at the bottom of the inhalation nozzle, yielding a rich aroma that is comfortable to inhale, and a satisfactory smoking experience. In addition, the cigarette tar atomizing smoke can significantly reduce the harshness of the cigarette baking smoke, thus greatly improving the inhalation comfort and smoking experience. Meanwhile, the cigarette baking smoke can effectively suppress the sweet greasy feeling of the cigarette tar atomizing smoke. Therefore the two types of smoke (the atomized cigarette tar and baked cigarette smoke) counteract each other's deficiencies allowing a reduction in the harshness of the baked cigarette smoke and an improvement in the flavor of the atomized tar smoke. The overall quality of the combined smoke is improved including the smoothness, aroma, and quality.

The first heating cavity and the second heating cavity of the atomizing device of the present invention utilize the self-developed zone heating and using method, and perform sectional heating and baking control on the cigarette based on different time-temperature requirements to ensure the uniform release of smoke. That is, the smoke generated amount is more uniform, and utilization rate of the cigarette is obviously improved. The heating cavity weight-averages the multi-point temperature collected in real time by the temperature sensing module and transmits to the microcontroller for dynamic feedback control. The temperature control for aroma generation is accurate, the response speed of temperature control is fast, and the utilization of the cigarette is sufficient.

The atomizing device of the present invention adopts a separate airflow channel structure, which realizes the independent channel transmission of the cigarette tar atomizing smoke and the cigarette baking smoke. This solves the problem of uneven distribution of the airflow in the coincident channel, and reduces the risk of circuit failure caused by the adhesion of tar to the atomizer electrode.

The atomizing device of the present invention adopts the retractable inhalation nozzle. The inhalation nozzle can retract into the cavity of the upper end cover when not inhaling, which realizes dustproof and sanitary protection and reduces the overall size of the atomizing device. The overall cross section of the atomizing device is designed in a Y-shaped structure, which is convenient for the user to hold, prevents rolling and improves the comfort and safety of use. The air outlet channels of two kinds of smoke adopts a Z-shaped structure, which effectively reduces the temperature of the cigarette tar atomizing smoke and/or the cigarette baking smoke, reduces the harshness and improves the softness and fullness of the inhalation. The charging interface has the firmware upgrade function, which brings great convenience to the user upgrade, and enables the user to experience the new function in time.

In the FIGS.: 1. upper end cover, 11. section nozzle, 12. first air outlet channel, 13. second air outlet channel, 14. magnetic column, 2. main support, 21. upper cover board, 211. atomizer base, 212. cigarette insertion hole, 213. magnet, 22. lower cover board, 2211. first position sensing contact, 2212. second position sensing contact, 2213. third position sensing contact, 2221. first air inlet, 2222. second air inlet, 3. control circuit board, 31. microcontroller, 32. power management module, 33. cigarette tar atomizing control module, 34. cigarette baking control module, 35 information display module, 36. key detection module, 37. mode analysis module, 38. temperature sensing module, 4. lower end cover, 41. mode switching disc, 411. first mode identification, 412. second mode identification, 413. third mode identification, 42. rotating pad, 421. rotating position contact, 422. air inlet sealing plug, 43. self-locking rotating shaft, 44. fastening assembly, 45. mode alignment identification, 5. atomizer, 6. cigarette baking component, 61. first heating cavity, 62. second heating cavity, 63. filter tip accommodating cavity, 64. temperature sensor, 65. thermal insulation assembly, 7. main body housing, 71. main key, 72. display screen, 73. charging interface, 8. gathering assembly.

DETAILED DESCRIPTION OF THE EMBODIMENTS

In order to make the objects, technical solutions, and advantages of the present invention more comprehensible; the present invention will be further described in detail with reference to the drawings and the embodiments.

Figure 1:
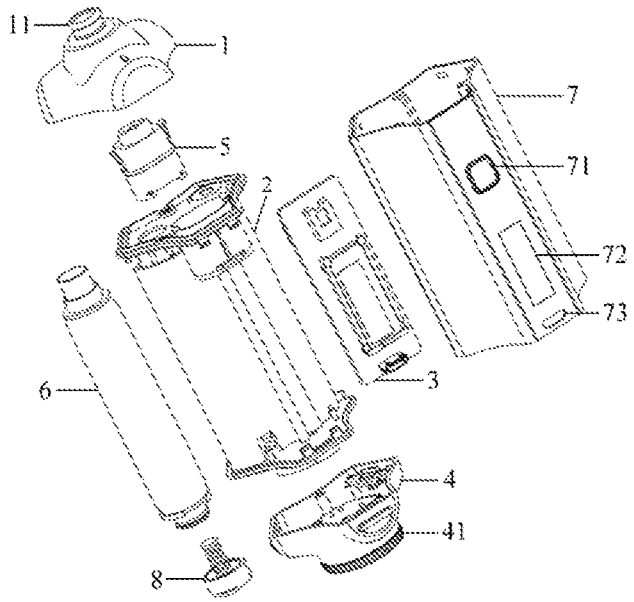
FIG. 1 is an exploded view of an atomizing device supporting multiple inhalation modes of the present invention.

A structural schematic view of the atomizing device supporting multiple inhalation modes according to an embodiment of the present invention is shown in FIG. 1. The atomizing device includes the following components. The main body housing 7 is provided and is substantially cylinder-shaped with an upper end opening and a lower end opening.

The main support 2 is provided and is located in the main body housing 7. The top and bottom of the main support 2 are provided with the upper cover board 21 and the lower cover board 22, respectively. The upper cover board 21 and the lower cover board 22 are fixedly connected by the segregation boards, and the space between the upper cover board 21 and the lower cover board 22 is divided into several cavities by the segregation boards. The control circuit board 3, the cigarette baking component 6 and the battery are placed in the different cavities.

Figure 4:
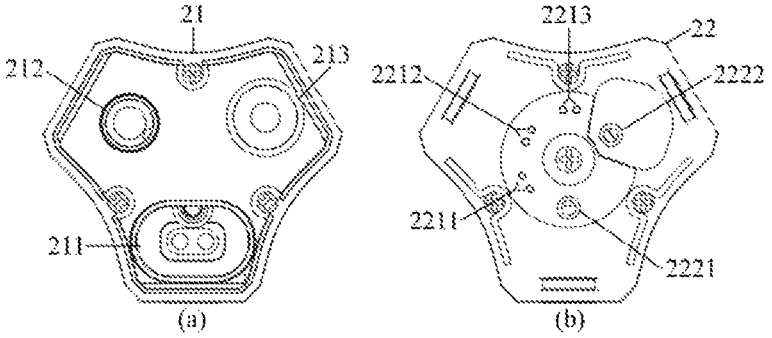
FIG. 4 is a schematic view of the upper cover board (a) and the lower board (b) of the main support of the atomizing device of the present invention.

The upper cover board 21 is provided and is substantially sheet-shaped. The upper end surface of the upper cover board 21 is provided with the magnet 213 and the atomizer base 211, and the cigarette insertion hole 212 is formed on the upper cover board 21 by penetrating the end surface. The lower cover board 22 is provided and is substantially sheet-shaped. The lower end surface of the lower cover board 22 is provided with three position sensing contacts, namely the first position sensing contact 2211, the second position sensing contact 2212 and the third position sensing contact 2213. The first air inlet 2221 and the second air inlet 2222 are formed on the lower cover board 22 by penetrating the end surface. This part described is shown in FIG. 4.

Figure 2:
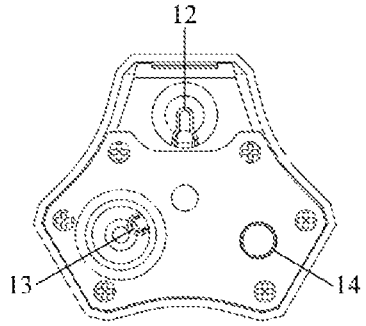
FIG. 2 is a schematic view of the lower end surface of the upper end cover of the atomizing device of the present invention.
Figure 3:
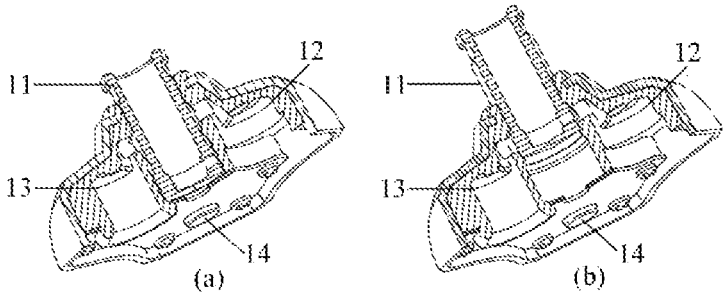
FIG. 3 is a schematic view when the inhalation nozzle of the atomizing device of the present invention retracts into the cavity of the upper end cover (a) and extends out to be used (b).

The upper end cover 1 is provided and is substantially cone-shaped, wherein the end of the cone is the inhalation nozzle 11, and the lower end surface of the cone is adapted to the upper end opening of the main body housing 7. The lower end surface of the cone is provided with two holes separate to each other leading into the cavity of the cone as the first air outlet channel 12, the second air outlet channel 13, and the lower end surface of the cone is further provided with the magnetic column 14. This part is described as shown in FIGS. 2 and 3.

The atomizer 5 is provided. The atomizer 5 is disposed on the atomizer base 211, wherein the atomizer 5 is fixed to the atomizer base 211 by a magnetic manner, a screwing manner, or a snap manner, and realizes an electrical connection.

Figure 6:
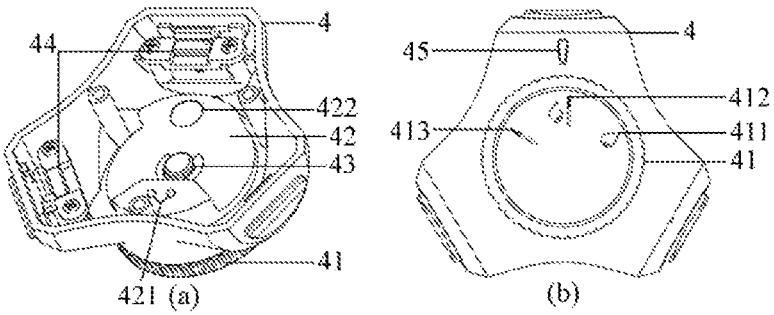
FIG. 6 is a schematic view of the upper end surface (a) and the lower end surface (b) of the lower end cover of the atomizing device of the present invention.

The lower end cover 4 is provided. The upper end surface of the lower end cover 4 is adapted to the lower end opening of the main body housing 7, and the lower end surface of the lower end cover 4 is provided with the mode switching disc 41, wherein the mode switching disc 41 is connected to the rotating pad 42 located on the upper end surface of the lower end cover 4 through the self-locking rotating shaft 43. The rotating position contact 421 and the air inlet sealing plug 422 opposite each other are disposed on the rotating pad 42 along the self-locking rotating shaft 43, and the connection line between the rotating position contact 421 and the air inlet sealing plug 422 passes through the self-locking rotating shaft 43. The lower end surface of the mode switching disc 41 is provided with three identifications, namely the first mode identification 411, the second mode identification 412, and the third mode identification 413. The edge of the upper end surface of the lower end cover 4 is provided with the fastening assemblies 44. This part described is shown in FIG. 6.

The connection manner of each component is as follows.

The upper end cover 1 and the main support 2 are tightly engaged by the magnetic effect between the magnetic column 14 and the magnet 213. The lower end cover 4 and the main support 2 are connected in the snap manner by the fastening assemblies 44, and at this time, the upper end surface of the lower end cover 4 is affixed to the lower end surface of the lower cover board 22. The upper port of the cigarette baking component 6 corresponds to the cigarette insertion hole 212. The magnetic column 14 is substantially column-shaped, and a material thereof is one of iron, cobalt, nickel or other magnetic materials. A material of the magnet 213 is one of neodymium iron boron magnet, ferrite magnet, samarium cobalt magnet, aluminum nickel cobalt magnet or iron chrome cobalt magnet. Generally, the control circuit board 3 is disposed directly under the atomizer base 211, and the battery is placed directly under the magnet 213.

The atomizing device further includes the gathering assembly 8. The gathering assembly 8 is detachably placed at the lower port of the cigarette baking component 6. The gathering assembly 8 collects the condensate such as the tar generated during the cigarette baking process.

Figure 7:
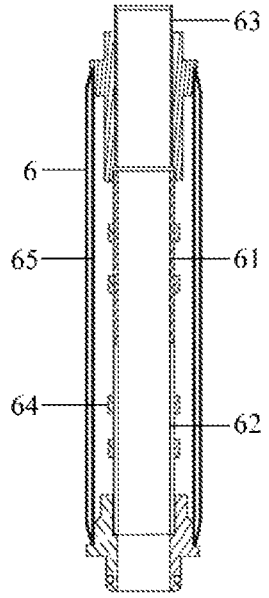
FIG. 7 is an axial cross-sectional view of the cigarette baking component of the atomizing device of the present invention.

As is shown in FIG. 7, the cigarette baking component 6 is cylinder-shaped. The outer wall of the cylinder body is wrapped with the thermal insulation assembly 65. The filter tip accommodating cavity 63, the first heating cavity 61 and the second heating cavity 62 are, from top to bottom, placed in the inner cavity of the cylinder body. The first heating cavity 61 and the second heating cavity 62 adopt an integrated structure design and a zone heating and using method, and the heating cavity may be a metal cup, a ceramic cup printed with a heating circuit or a glass cup. The cavity wall of the first heating cavity 61 and the second heating cavity 62 is provided with the temperature sensor 64. The first heating cavity 61 and the second heating cavity 62 are used for accommodating a cigarette, wherein the cigarette includes a general burning and inhaling cigarette, a heating and non-burning cigarette, and a dual-purpose cigarette in the general burning and inhaling manner and the heating non-burning manner. The temperature sensing module 38 feeds back temperatures of the first heating cavity 61 and the second heating cavity 62 to the microcontroller 31. The thermal insulation assembly 65 is made of one of a porous material, a heat reflective material or a vacuum material.

Figure 5:
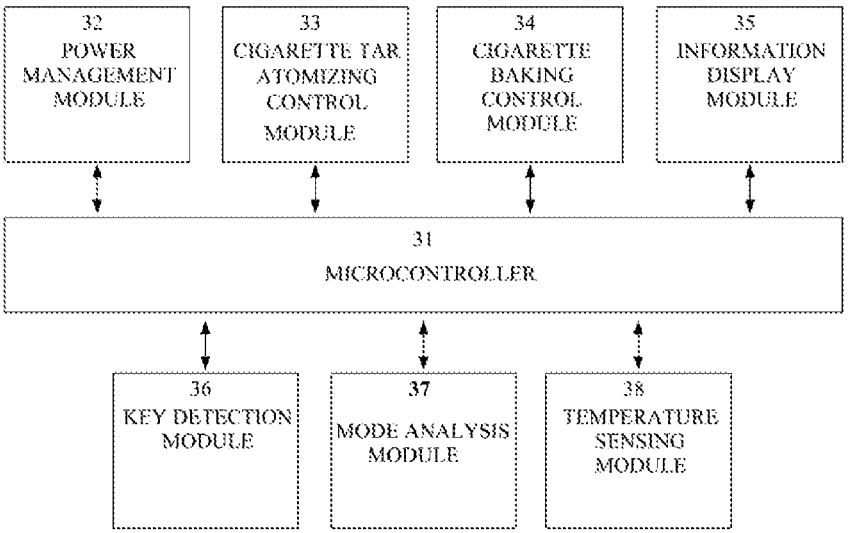
FIG. 5 is a structural block diagram of the control circuit board of the atomizing device of the present invention.

As shown in FIG. 5, the structure of the control circuit board 3 includes the microcontroller 31, the power management module 32, the cigarette tar atomizing control module 33, the cigarette baking control module 34, the information display module 35, the key detection module 36, the mode analysis module 37 and the temperature sensing module 38.

As shown in FIG. 1, the main body housing 7 has a substantially Y-shaped cross section, and the outer wall of the main body housing 7 is provided with the main key 71, the display screen 72 and the charging interface 73. The charging interface 73 can both charge the atomizing device and realize firmware upgrade of the atomizing device.

As shown in FIG. 3, the inhalation nozzle 11 has a retractable structure. When the inhalation nozzle 11 retracts into the cavity of the upper end cover 1, the inhalation nozzle 11 is in a non-communication state with the first air outlet channel 12 and the second air outlet channel 13. When the inhalation nozzle 11 extends out to be used, the inhalation nozzle 11 is in a communication state with the first air outlet channel 12 and the second air outlet channel 13. The first air outlet channel 12 or the second air outlet channel 13 is a Z-shaped arrangement in the cavity of the cone, and the first air outlet channel 12 and the second air outlet channel 13 are used for outputting the cigarette tar atomizing smoke and the cigarette baking smoke, respectively. Preferably, the first air inlet 2221 serves as an air inlet through-hole for cigarette tar atomizing; the second air inlet 2222 serves as an air inlet through-hole for cigarette baking.

As shown in FIG. 4 (*b*), the first air inlet 2221 is arranged opposite to the third position sensing contact 2213. The second air inlet 2222 is arranged opposite to the first position sensing contact 2211. The air inlet sealing plug 422 is adapted to the first air inlet 2221 or the second air inlet 2222, that is, the air inlet sealing plug 422 can close or open the first air inlet 2221 or the second air inlet 2222.

As shown in FIG. 6 (*b*), the first mode identification 411, the second mode identification 412 and the third mode identification 413 correspond to the cigarette tar atomizing mode, the "cigarette tar atomizing+cigarette baking" mixed mode and the cigarette baking mode, respectively. The mode switching disc 41 drives the rotating pad 42 to rotate by the self-locking rotating shaft 43. The self-locking rotating shaft 43 supports the self-locking positioning of the rotating position contact 421 and three position sensing contacts on the lower end surface of the lower cover board 22. When the rotating position contact 421 is in the alignment connection with the first position sensing contact 2211, the air inlet sealing plug 422 closes the second air inlet 2222, and at this time, the cigarette tar atomizing mode is presented and the first air inlet 2221 serves as the air inlet through-hole for cigarette tar atomizing. When the rotating position contact 421 is in the alignment connection with the third position sensing contact 2213, the air inlet sealing plug 422 closes the first air inlet 2221, and at this time, the cigarette baking mode is presented and the second air inlet 2222 serves as the air inlet through-hole for cigarette baking. When the rotating position contact 421 is in the alignment connection with the second position sensing contact 2212, both the first air inlet 2221 and the second air inlet 2222 are opened, and at this time, the "cigarette tar atomizing+cigarette baking" mixed mode is presented.

The above is an explanation of the atomizing device supporting multiple inhalation modes of the present invention. The method for using the atomizing device of the present invention is further described below, and the method specifically includes the following steps.

The mode switching disc 41 is rotated to select the inhalation mode of the atomizing device, and the self-locking rotating shaft 43 is used to perform the self-locking positioning, leading the first mode identification 411, the second mode identification 412 or the third mode identification 413 corresponds to the mode alignment identification 45. Meanwhile, the rotating position contact 421 is automatically in the alignment connection with the first position sensing contact 2211, the second position sensing contact 2212 or the third position sensing contact 2213, wherein the first position sensing contact 2211, the second position sensing contact 2212 or the third position sensing contact 2213 matches the inhalation mode, and the air inlet sealing plug 422 synchronously opens the first air inlet 2221 and/or the second air inlet 2222.

The microcontroller 31, the power management module 32, the information display module 35, the key detection module 36, and the mode analysis module 37 all operate. Meanwhile, the mode analysis module 37 detects the situation around the alignment connection between the first position sensing contact 2211, the second position sensing contact 2212 or the third position sensing contact 2213 and the rotating position contact 421 in real time, analyzes position information, and then feeds back the information to the microcontroller 31. Then, the microcontroller 31 determines the inhalation mode and activates each control circuit board module corresponding to the inhalation mode to work and generate smoke for a user to inhale. That is, in the cigarette tar atomizing mode, the cigarette tar atomizing control module 33 operates, and smoke is generated by cigarette tar atomizing; in the cigarette baking mode, the cigarette baking control module 34 and the temperature sensing module 38 operate in cooperation, and smoke is generated by cigarette baking; in the "cigarette tar atomizing+cigarette baking" mixed mode, the cigarette tar atomizing control module 33, the cigarette baking control module 34 and the temperature sensing module 38 operate in cooperation to generate mixed smoke of cigarette tar atomizing smoke and cigarette baking smoke.

When the atomizing device of the present embodiment operates in the cigarette tar atomizing mode, the cigarette tar atomizing smoke may be inhaled as long as the main key 71 is pressed. The key detection module 36 detects duration of pressing the key in real time, and when the duration exceeds a set value (generally 10 seconds), the microcontroller 31 controls the cigarette tar atomizing control module 33 to stop output, so as to prevent the phenomenon of continuous high heating or melting from occurring in the heating coil of the atomizer 5. After a few seconds, the user may use the atomizing device again. When the atomizing device operates in the cigarette baking mode, the key detection module 36 synchronously detects the key action. When the main key 71 is detected to be pressed twice, the microcontroller 31 triggers the cigarette baking module 34 to operate and perform the zone heating on the cigarette by the first heating cavity 61 and the second heating cavity 62. The cigarette icon in the display screen 72 dynamically displays the heating progress. After the heating is completed, the smoke animation appears on the front end of the cigarette icon to prompt the user that they can inhale the cigarette baking smoke. When the smoke animation disappears, it indicates that the cigarette has been fully consumed, and if the user wants to continue inhaling, the user needs to replace the cigarette. When the atomizing device operates in the "cigarette tar atomizing+cigarette baking" mixed mode, the main key 71 is pressed twice to start the cigarette heating. When the smoke animation appears on the front end of the cigarette icon in the display screen 72, the mixed inhalation can be realized by long pressing the main key 71.

Figure 8:
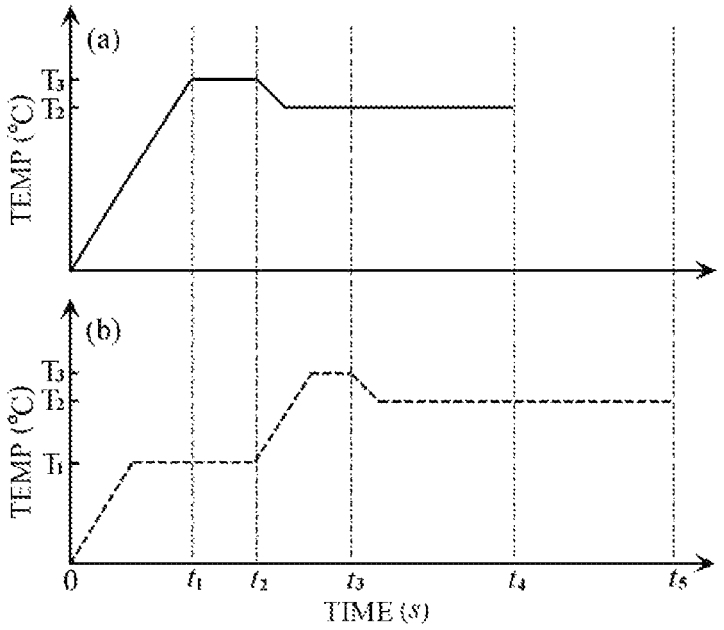
FIG. 8 is a time-temperature graph of the first heating cavity (a) and the second heating cavity (b) of the cigarette baking component of the atomizing device of the present invention.

The heating and using method of the first heating cavity and the second heating cavity of the cigarette baking component 6 of the present embodiment of the present invention is described below with reference to FIG. 8, and the method includes the following steps:

1) in the 0-$t_1$ time period, the first heating cavity 61 and the second heating cavity 62 are heated synchronously, the first heating cavity 61 is continuously heated to $T_3$, and the second heating cavity 62 maintains the constant temperature after being heated to $T_1$;

2) in the $t_1$-$t_2$ time period, the first heating cavity 61 and the second heating cavity 62 maintain constant temperatures $T_3$ and $T_1$, respectively;

3) in the $t_2$-$t_3$ time period, the first heating cavity 61 maintains the constant temperature after being cooled to $T_2$, and the second heating cavity 62 maintains the constant temperature after being heated to $T_3$;

4) in the $t_3$-$t_4$ time period, the first heating cavity 61 continues to maintain the constant temperature $T_2$, and the second heating cavity 62 maintains the constant temperature after being cooled to $T_2$;

5) in the $t_4$-$t_5$ time period, the first heating cavity 61 stops being heated, the second heating cavity 62 continues to maintain the constant temperature $T_2$, and when time is greater than $t_5$, the second heating cavity 62 stops being heated;

wherein, the order of the temperatures is $T_1<T_2<T_3$.

Figure 9:
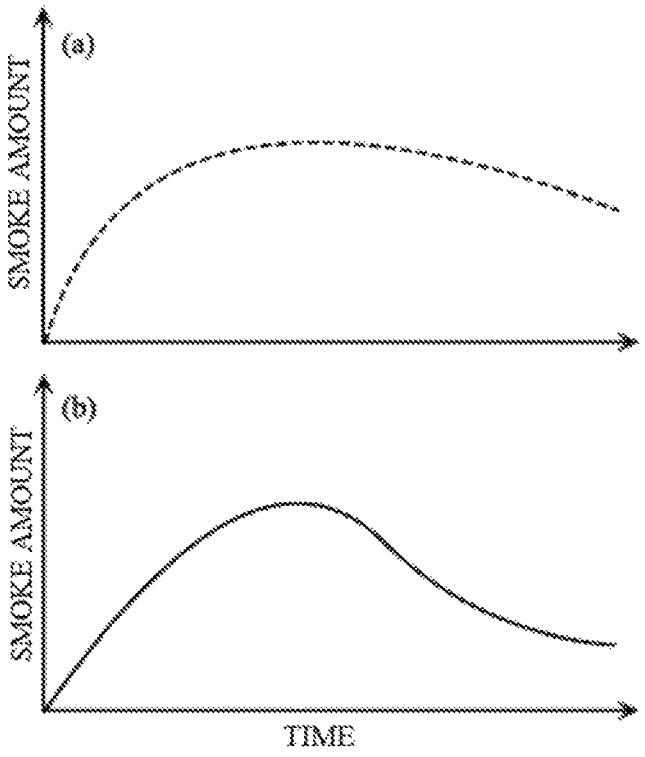
FIG. 9 is a smoke amount-time graph (a) when the cigarette baking component of the atomizing device of the present invention performs sectional heating and baking on a cigarette and a smoke amount-time graph (b) when a general cigarette baking component performs heating and baking on a cigarette.

In the present embodiment of the present invention, the heating time $t_1$, $t_2$, $t_3$, $t_4$ and $t_5$ are set to 15 seconds, 25 seconds, 35 seconds, 55 seconds, and 75 seconds, respectively, and the heating temperatures $T_1$, $T_2$ and $T_3$ are set to 220° C., 260° C., and 280° C., respectively. FIG. 9 (*a*) shows the smoke amount-time graph when the cigarette baking component of the present invention performs sectional heating and baking on a cigarette, and FIG. 9 (*b*) shows the smoke amount-time graph when a general cigarette baking component performs heating and baking on a cigarette. It can be seen from FIG. 9 that the smoke amount of the general cigarette baking component rapidly increases when the inhalation is started, but as the inhalation time lapses, the smoke amount gradually decreases. The smoke amount released by the cigarette baking component of the atomizing device of the present invention during the inhalation process is more uniform.

The above is only a preferred embodiment of the present invention and is not intended to limit the present invention. For those skilled in the art, any of the modifications, equivalent substitutions and improvements made without creative labors, according to the technical solutions or the technical features disclosed in the present invention, fall in the protective scope of the present invention.

What is claimed is:

1. An atomizing device supporting multiple inhalation modes, comprising:

a main body housing, wherein the main body housing is cylinder-shaped with an upper end opening and a lower end opening;

a main support, wherein the main support is located in the main body housing; a top of the main support is provided with an upper cover board and a bottom of the main support is provided with a lower cover board; the upper cover board and the lower cover board are fixedly connected by a plurality of segregation boards, and a space between the upper cover board and the lower cover board is divided into a plurality of cavities by the plurality of segregation boards; a control circuit board, a cigarette baking component and a battery are placed in the plurality of cavities;

wherein an upper end surface of the upper cover board is provided with a magnet and an atomizer base, and a cigarette insertion hole is further formed on the upper cover board;

wherein a lower end surface of the lower cover board is provided with a first position sensing contact, a second position sensing contact and a third position sensing contact; a first air inlet and a second air inlet are further formed on the lower cover board;

an upper end cover, wherein a top of the upper end cover is provided with a inhalation nozzle; a lower end surface of the upper end cover is adapted to the upper end opening of the main body housing, and the lower end surface of the upper end cover is provided with two holes separate to each other leading into a cavity of a cone as a first air outlet channel and a second air outlet channel; the lower end surface of the upper end cover is further provided with a magnetic column;

an atomizer, wherein the atomizer is disposed on the atomizer base;

a lower end cover, wherein an upper end surface of the lower end cover is adapted to the lower end opening of the main body housing, and a lower end surface of the lower end cover is provided with a mode switching disc; the mode switching disc is connected to a rotating pad located on the upper end surface of the lower end cover through a self-locking rotating shaft; the rotating pad is provided with a rotating position contact and an air inlet sealing plug and a connection line between the rotating position contact and the air inlet sealing plug passes through the self-locking rotating shaft (43); a lower end surface of the mode switching disc is provided with a first mode identification, a second mode identification and a third mode identification; an edge of the upper end surface of the lower end cover is provided with a fastening assembly;

wherein the upper end cover and the main support are tightly engaged by a magnetic effect between the magnetic column and the magnet; the lower end cover and the main support are connected in a snap manner by the fastening assembly; an upper port of the cigarette baking component corresponds to the cigarette insertion hole.

2. The atomizing device according to claim 1, wherein, the cigarette baking component is cylinder-shaped; an outer wall of a cylinder body of the cigarette baking component is wrapped with a thermal insulation assembly; a filter tip accommodating cavity a first heating cavity and a second heating cavity are, from top to bottom, placed in an inner cavity of the cylinder body; a cavity wall of the first heating cavity and a cavity wall of the second heating cavity is are provided with a plurality of temperature sensors; the first heating cavity and the second heating cavity are configured to accommodate a cigarette.

3. The atomizing device according to claim 2, further comprising a gathering assembly; wherein the gathering assembly is detachably placed at a lower port of the cigarette baking component.

4. The atomizing device according to claim 1, wherein, the control circuit board comprises a microcontroller, a power management module, a cigarette tar atomizing control module, a cigarette baking control module, an information display module, a key detection module, a mode analysis module and a temperature sensing module.

5. The atomizing device according to claim 1, wherein, the main body housing has a Y-shaped cross section, and an outer wall of the main body housing is provided with a main key, a display screen and a charging interface.

6. The atomizing device according to claim 1, wherein, the inhalation nozzle has a retractable structure; when the inhalation nozzle retracts into a cavity of the upper end cover, the inhalation nozzle is in a non-communication state with the first air outlet channel and the second air outlet channel; when the inhalation nozzle extends out to be used, the inhalation nozzle is in a communication state with the first air outlet channel and the second air outlet channel; the first air outlet channel or the second air outlet channel is a Z-shaped arrangement in the cavity of the cone.

7. The atomizing device according to claim 1, wherein, the first air inlet is arranged opposite to the third position sensing contact; the second air inlet is arranged opposite to the first position sensing contact; the air inlet sealing plug is adapted to the first air inlet or the second air inlet.

8. The atomizing device according to claim 1, wherein, the first mode identification, the second mode identification and the third mode identification correspond to a cigarette tar atomizing mode, a "cigarette tar atomizing+cigarette baking" mixed mode and a cigarette baking mode, respectively.

9. A method of using the atomizing device according to claim 1, comprising the following steps:

rotating the mode switching disc to select a inhalation mode of the atomizing device, and using the self-locking rotating shaft to perform a self-locking positioning, leading that the first mode identification, the second mode identification or the third mode identification corresponds to a mode alignment identification; wherein, meanwhile, the rotating position contact is automatically in an alignment connection with the first position sensing contact, the second position sensing contact or the third position sensing contact, wherein the first position sensing contact, the second position sensing contact or the third position sensing contact matches the inhalation mode, and the air inlet sealing plug synchronously opens the first air inlet and/or the second air inlet;

meanwhile, a mode analysis module detects a difference regarding the alignment connection between the first position sensing contact, the second position sensing contact or the third position sensing contact and the rotating position contact in real time, analyzes position information, and feeds the position information back to the microcontroller; then, the microcontroller determines the inhalation mode and activates each control circuit board module corresponding to the inhalation mode to work and generate smoke for a user to inhale; in a cigarette tar atomizing mode, the cigarette tar atomizing control module operates, and smoke is generated by cigarette tar atomizing; in a cigarette baking mode, a cigarette baking control module and a temperature sensing module operate in cooperation, and smoke is generated by cigarette baking; in a "cigarette tar atomizing+cigarette baking" mixed mode, the cigarette tar atomizing control module, the cigarette baking control module and the temperature sensing module operate in cooperation to generate mixed smoke of cigarette tar atomizing smoke and cigarette baking smoke.

10. A method of using the atomizing device according to claim 3, comprising the following steps:

1) in a $0\text{-}t_1$ time period, the first heating cavity and the second heating cavity are heated synchronously, the first heating cavity is continuously heated to $T_3$, and the second heating cavity maintains a constant temperature after being heated to $T_1$;

2) in a $t_1\text{-}t_2$ time period, the first heating cavity and the second heating cavity maintain constant temperatures $T_3$ and $T_1$, respectively;

3) in a $t_2\text{-}t_3$ time period, the first heating cavity maintains a constant temperature after being cooled to $T_2$, and the second heating cavity maintains a constant temperature after being heated to $T_3$;

4) in a $t_3\text{-}t_4$ time period, the first heating cavity continues to maintain the constant temperature $T_2$, and the second heating cavity maintains a constant temperature after being cooled to $T_2$;

5) in a $t_4\text{-}t_5$ time period, the first heating cavity stops being heated, the second heating cavity continues to maintain the constant temperature $T_2$, and when time is greater than $t_5$, the second heating cavity stops being heated;

wherein, the order of temperatures is $T_1<T_2<T_3$.

11. The method of using the atomizing device according to claim 9, wherein, the cigarette baking component is cylinder-shaped; the outer wall of the cylinder body of the cigarette baking component is wrapped with the thermal insulation assembly; the filter tip accommodating cavity, the first heating cavity and the second heating cavity are, from top to bottom, placed in the inner cavity of the cylinder body; the cavity wall of the first heating cavity and the cavity wall of the second heating cavity are provided with the the plurality of temperature sensors; the first heating cavity and the second heating cavity are configured to accommodate the cigarette.

12. The method of using the atomizing device according to claim 11, further comprising the gathering assembly; wherein the gathering assembly is detachably placed at the lower port of the cigarette baking component.

13. The method of using the atomizing device according to claim 9, wherein, the control circuit board comprises the microcontroller, the power management module, the cigarette tar atomizing control module, the cigarette baking control module, the information display module, the key detection module, the mode analysis module and the temperature sensing module.

14. The method of using the atomizing device according to claim 9, wherein, the main body housing has the Y-shaped cross section, and the outer wall of the main body housing is provided with the main key, the display screen and the charging interface.

15. The method of using the atomizing device according to claim 9, wherein, the inhalation nozzle has the retractable structure; when the inhalation nozzle retracts into the cavity of the upper end cover, the inhalation nozzle is in the non-communication state with the first air outlet channel and the second air outlet channel; when the inhalation nozzle extends out to be used, the inhalation nozzle is in the communication state with the first air outlet channel and the second air outlet channel the first air outlet channel or the second air outlet channel is the Z-shaped arrangement in the cavity of the cone.

16. The method of using the atomizing device according to claim 9, wherein, the first air inlet is arranged opposite to the third position sensing contact; the second air inlet is arranged opposite to the first position sensing contact; the air inlet sealing plug is adapted to the first air inlet or the second air inlet.

17. The method of using the atomizing device according to claim 9, wherein, the first mode identification, the second mode identification and the third mode identification correspond to the cigarette tar atomizing mode, the "cigarette tar atomizing+cigarette baking" mixed mode and the cigarette baking mode, respectively.

* * * * *